US006347598B1

(12) United States Patent
Fontenot et al.

(10) Patent No.: US 6,347,598 B1
(45) Date of Patent: Feb. 19, 2002

(54) UPLIFT SPRING ASSEMBLY TO COMPENSATE FOR HULL DEFLECTION AT MAIN BEARING OF A MOORING TURRET

(75) Inventors: William L. Fontenot; Miles A. Hobdy; L. Terry Boatman, all of Houston, TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/680,593

(22) Filed: Oct. 6, 2000

Related U.S. Application Data

(60) Provisional application No. 60/158,001, filed on Oct. 6, 1999.

(51) Int. Cl.[7] ..... B63B 21/00

(52) U.S. Cl. ..... 114/230.13; 441/3; 405/224

(58) Field of Search ..... 114/230.1, 230.12, 114/230.13, 230.16, 293; 441/3–5; 405/224; 166/352

(56) References Cited

U.S. PATENT DOCUMENTS

| | | | |
|---|---|---|---|
| 4,955,310 | A | 9/1990 | Pollack |
| 5,052,322 | A | 10/1991 | Poldervaart et al. |
| 5,306,186 | A | 4/1994 | Boatman |
| 5,356,321 | A | 10/1994 | Boatman et al. |
| 5,515,804 | A | 5/1996 | Pollack |
| 5,782,197 | A | 7/1998 | Pollack |

FOREIGN PATENT DOCUMENTS

| | | |
|---|---|---|
| WO | 96/27522 | 9/1996 |

*Primary Examiner*—Jesus D. Sotelo
(74) *Attorney, Agent, or Firm*—Gary L. Bush; Andrews, Kurth, Mayor, Day, Caldwell & Keeton

(57) ABSTRACT

An uplift spring assembly to compensate for hull deflection at a main bearing of a mooring turret is disclosed. Elastomeric pads are used to react turret uplift because of their properties of large deflections and resistance to cold weather. Tie rods are provided to transmit the uplift loads into the elastomeric pads. The elastomeric pads react the uplift loads in compression. The assembly arrangement prevents the elastomeric pads from reacting tension loads.

12 Claims, 1 Drawing Sheet

UPLIFT SPRING ASSEMBLY TO COMPENSATE FOR HULL DEFLECTION AT MAIN BEARING OF A MOORING TURRET

CROSS REFERENCE TO RELATED APPLICATION

This application claims priority from U.S. Provisional Application 60/158,001 filed Oct. 6, 1999.

BACKGROUND OF THE INVENTION

1. Field of the Invention

This invention relates to an uplift spring assembly for the main bearing of a mooring turret to compensate for the hull deflection or distortion of the moored vessel.

2. Description of the Prior Art

Heretofore, springs have been provided for supporting the upper bearing of a mooring turret for a moored vessel. The mooring turret is usually mounted for rotation within a moon pool in the body or hull of the vessel. The vessel weathervanes about the turret which is anchored to the sea floor.

U.S. Pat. No. 5,306,186 dated Apr. 26, 1994 illustrates a mooring system including a turret supported within a moon pool on a main upper bearing mounted on the hull of the moored vessel. An upper turret support ring on the body of the vessel has a plurality of elastomeric pads equally spaced about the outer periphery of the turret for absorbing vertical shocks between the turret and the vessel. The elastomeric pads function to minimize moment load imbalances between the turret and vessel and to compensate for manufacturing tolerances of the upper bearing supports. The elastomeric pads are placed in compression upon downward movement of the turret relative to the body of the vessel.

3. Identification of Object of the Invention

A principal object of the invention is to provide an elastomeric spring assembly for the upper bearing of a mooring turret which includes a first elastomeric spring which is placed in compression upon an upward movement or uplifting of the turret relative to the vessel and a second elastomeric spring which is placed in compression upon a downward movement of the turret relative to the vessel.

SUMMARY OF THE INVENTION

The object identified above as well as other objects and features of the invention are provided in a spring assembly for the upper main bearing between a mooring turret and a vessel. An elastomeric spring is provided to react against turret uplift loads and downlift loads. A load applying horizontal ring connected to the main upper bearing has upper and lower elastomeric pads positioned on opposed sides thereof. A tie-rod extends through the load applying ring and the opposed elastomeric pads. The tie-rod is anchored at its lower end to a base support on the vessel. The upper end of the tie-rod is anchored an upper retaining plate. Upon an upward or uplifting movement of the turret, the tie-rod is effective to prevent movement of the retaining plate for transmitting a compressive force against the upper elastomeric pad thereof to permit the absorbing of the uplifting force by compression of the upper elastomeric pad. The lower elastomeric pad is compressed against the base support on the vessel by the load applying ring and is effective to absorb a downward force from the turret and load applying ring.

DESCRIPTION OF THE INVENTION

Figure 1:
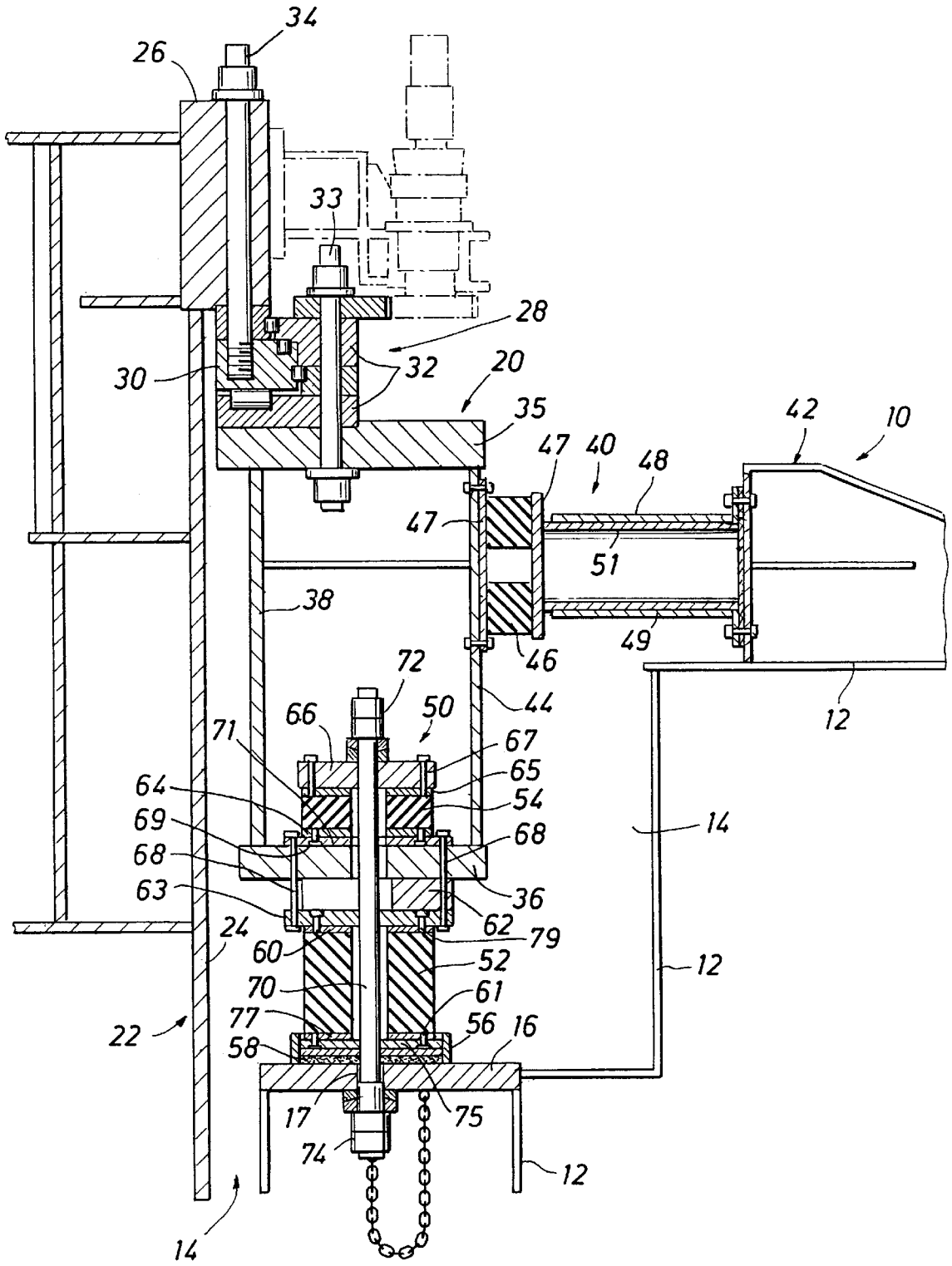
FIG. 1 is a cross-sectional view of a spring assembly which embodies the present invention and which is positioned between the vessel and the upper main bearing for a turret mounted in a moon pool of the vessel.

Referring to FIG. 1, a vessel shown at 10 has a hull 12 with a moon pool generally indicated at 14 extending through the hull or body 12 of vessel 10. A horizontal base support ring 16 on hull 12 adjacent moon pool 14 is mounted on vessel hull 12 and supports a spring assembly generally indicated at 20 for turret 22 mounted within moon pool 14. Turret 22 is anchored to the sea floor by a plurality of mooring lines or anchor legs (not shown). The vessel 10 weatherwanes about turret 22 in a manner that is well known.

A plurality of spring assemblies 20, such as twenty, for example, are equally spaced about the outer periphery 24 of turret 22. FIG. 1 shows a single spring assembly 20 according to the invention for illustration. Turret 22 includes an upper turret shear ring 26 which extends outwardly from the outer periphery 24 of turret 22. Shear ring 26 supports turret 22 on a main upper bearing generally indicated at 28 which includes an inner ring 30 mounted on bearings within outer rings 32. Suitable studs 34 secure turret shear ring 26 to inner bearing ring 30. Outer bearing rings 32 are secured by studs 33 to an upper load applying support ring 35 of spring assembly 20. Spring assembly 20 includes lower load applying support ring 36. Annular vertical member 38 is secured between load applying support rings 35 and 36. A flanged plate 44 is secured between support rings 35 and 36 at the position for each radial spring assembly 40 about the periphery of the turret 22.

Spring assembly 20 includes a radial spring subassembly generally indicated at 40 mounted between an abutment 42 on hull 12 and a vertical member 44 secured between rings 35 and 36. Radial spring subassembly 40 includes an elastomeric pad 46 between the flanged plate 44 and an opposed plate 47 and is adapted to absorb or dampen radial loads from turret 22. Telescoping cylinders 49, 51, which are slidable relative to each other, prevent tensioning of elastomeric pad 46.

Spring assembly 20 also includes a vertical uplift spring assembly shown generally at 50 which embodies this invention. Vertical uplift spring assembly 50 is supported on base support ring 16 of hull 12 adjacent moon pool 14. Assembly 50 includes a lower elastomeric pad 52 below a load applying ring 36 and an upper elastomeric pad 54 above load applying ring 36.

A lower annular ring 56 extends upwardly from base plate support 16. Suitable leveling plates or shims 58 including a layer of epoxy (if needed) are positioned within ring 56 for leveling spring assembly 50. A lower plate 75 is attached by bolts 61 to ring 77 of the lower elastomeric pad 52 and slides with pad 52 inside ring 56 to prevent application of tension in pad 52. An upper plate 63 is secured by bolts 79 to ring 60 of lower elastomeric pad 52. Metallic rings 60, 77 are molded into lower pad 52. Metallic rings 64, 65 are molded into upper pad 54. Bolts 68 secure upper plate 63 and lower elastomeric pad 52 to the load applying ring 36. Bolts 68 also secure ring 71 of the upper elastomeric spring to load applying ring 36 as described below. A horse-shoe shaped spacer 62 is positioned between plate 60 and load applying ring 36 for in-service replacement of a single elastomeric pad 52.

Upper elastomeric pad 54 is secured by means of bolts 69 to a lower plate 71 via ring 64 which is also secured to the vertical load applying ring 36 by bolts 68. Upper elastomeric pad 54 has its molded ring 65 fixed to retaining plate 66 by bolts 67.

A central tie rod or threaded bolt 70 anchors vertical spring assembly 50 on base support ring 16 and vertical load applying ring 36. The upper end of tie rod 70 includes a suitable nut 72 washers abutting above retaining plate 66. The lower end of rod 70 has a suitable nut 74 washers abutting beneath base support 16. Tie rod 70 is arranged to slide downwardly when ring 36 moves downwardly (with ring 66 and elastomeric pad 54), through a hole 17 in plate 58 and ring 16. Thus, ring 66 is prevented from moving up more than a distance of the tie rod 70 between nuts 72, 74, yet ring 66 can move down with respect to ring 16 because rod 70 can slide down through hole 17. Ring 36 and ring 66 move down as a unit, but ring 36 can move upwardly with respect to ring 66.

Operation

Vertical spring subassembly 50 is operable upon relative downward movement of turret 22 with respect to vessel 12 to compress lower elastomeric pad 52 between base support plate 16 and load applying ring 36. Elastomeric pad 54 is not placed in tension during such downward movement of turret 22 and load applying ring 36 from the neutral position shown in FIG. 1, because the tie rod 70 slides through a hole 17 in base support ring 16. Thus, lower elastomeric pad 52 is put in compression effective to absorb or dampen vertical loads exerted in a downward direction by turret 22 and load applying ring 36, while upper elastomeric pad 54, moving downwardly with load applying ring 36 and retaining plate 66, is not placed in tension.

However, elastomeric pad 52 is not adapted to absorb any substantial upwardly directed vertical or uplifting loads. For this purpose, elastomeric pad 54 is provided. Upon relative upward movement of turret 22 with respect to vessel 12 from the position shown in FIG. 1, upward movement of load applying ring 36 relative to base support 16 and retaining plate 66 compresses elastomeric pad 54 between retaining plate 66 and load applying ring 36. Retaining plate 66 is held against upward movement by nut 72 on tie rod 70 anchored to support ring 16. Elastomeric pad 52 is not placed in tension upon upward movement of load applying ring 36 from the position of FIG. 1, because pad 52 is fixed to plate 36 by bolts 68 and plate 60, and because plate 75 slides upwardly within ring 56. The uplifting of turret 22 is transmitted by shear ring 26 to inner bearing ring 30, thence to outer bearing rings 32 and upper ring 35, and thence to vertical members 38, 44 and load applying ring 36 for exerting a compression load against upper elastomeric pad 54, and ultimately via plate 66 and tie rod 70 to support ring 16 on vessel 12.

From the above, an elastomeric spring assembly 50 has been provided in which upwardly directed vertical or uplifting loads exerted by the turret are absorbed or cushioned by an elastomeric element 54. Downwardly exerted movements by the turret are absorbed or cushioned by an elastomeric element 52.

While a preferred embodiment of the present invention has been illustrated in detail it is apparent that modifications and adaptations of the preferred embodiment will occur to those skilled in the art. However, it is to be expressly understood that such modifications and adaptations are within the spirit and scope of the present invention.

What is claimed is:

1. An axial support arrangement (50) for a turret (22) which is rotatably supported on a vessel (12) comprising, a support ring (16) mounted on said vessel (12);

a load applying ring (36) positioned outwardly of said turret (22) and rotatably coupled to said turret (22) at a position above said support ring (16);

a retaining plate (66) coupled to said support ring (16) at a position above said load applying ring (36);

an upper elastomeric pad (54) sandwiched between said load applying ring (36) and said retaining plate (66), said upper elastomeric pad (54) being coupled, arranged and dimensioned in cooperation with said retaining plate (66) and said load applying ring (36) to be put in compression with relative upward motion of said turret (22) with respect to said vessel (12) but not be put in tension with relative downward motion of said turret (22) with respect to said vessel (12).

2. The arrangement (50) of claim 1 wherein, said retaining plate (66) is coupled to said support ring (16) by a tie rod (70) which extends through a hole (17) in said support ring (16), said upper elastomeric pad (54) is fixed to said retainer plate (66) and to said load applying ring (36), whereby with relative upward motion of said turret (22) with respect to said vessel (12), said upper elastomeric pad (54) is squeezed between said retaining plate (66) and said load applying ring (36), but with relative downward motion of said turret (22) with respect to said vessel (12), said upper elastomeric pad (54) is prevented from being placed in tension by sliding of said tie rod (70) through said hole (17) in said support ring (16) as said load support ring (36) moves downward with respect to support ring (16).

3. The arrangement of claim 1 wherein, said retaining plate (66) is coupled to said support ring (16) by a tie rod (70) which extends through aligned holes in said retaining plate (66), said upper elastomeric pad (54), said load applying ring (36), and said support ring (16) and by nuts (72), (74) secured over said stud (70) above said retaining plate (66) and below said support ring (16).

4. The arrangement of claim 1, further comprising, a lower elastomeric pad (52) sandwiched between said load applying ring (36) and said support ring (16), said lower elastomeric pad (52) being coupled, arranged and dimensioned in cooperation with said load applying ring (36) and said retaining plate (66) to be put in compression with relative downward motion of said turret (22) with respect to said vessel (12) but not be put in tension with relative upward movement of said turret (22) with respect to said vessel (12).

5. The arrangement of claim 4 wherein, said lower elastomeric pad (52) is fixed axially relative to said load applying ring (36) but not to said support ring (16), whereby with relative downward motion of said turret (22) with respect to said vessel (12) said lower elastomeric pad (52) is squeezed between said support ring and said load applying ring (36), but with relative upward motion of said turret (22) with respect to said vessel (12), said lower elastomeric pad (54) stays fixed relative to said load applying ring (36) thereby preventing tension in said lower elastomeric pad (52).

6. The arrangement of claim 5 wherein, said mounting plate (16) includes an annular ring (56) extending upwardly from an upper side thereof, and said lower elastomeric pad (52) is arranged and designed to slide within said annular ring (56) whereby with relative downward motion of said turret (22) with respect to said vessel (12), said lower elastomeric pad (52) is squeezed between said load applying ring (36) and said retaining ring (16), but with relative upward motion of said turret (22) with said respect to said vessel (12), said lower elastomeric pad (52) is free to slide upwardly with respect to said annular ring (56).

7. An axial support arrangement (50) for a turret (22) which is rotatably supported on a vessel (12) comprising, a support ring (16) mounted on said vessel (12);

a load applying ring (36) positioned about the outer periphery of said turret (22) and rotatably coupled to said turret (22) at a position above said support ring (16);

a lower elastomeric pad (52) sandwiched between said load applying ring (36) and said support ring (16), said lower elastomeric pad (52) being coupled, arranged and dimensioned in cooperation with said load applying ring (36) and said retaining plate (66) to be put in compression with relative downward motion of said turret (22) with respect to said vessel (12) but not be put in tension with relative upward movement of said turret (22) with respect to said vessel (12).

8. The arrangement of claim 7 wherein, said lower elastomeric pad (52) is fixed axially relative to said load applying ring (36) but not to said support ring (16), whereby with relative downward motion of said turret (22) with respect to said vessel (12) said lower elastomeric pad (52) is squeezed between said support ring and said load applying ring (36), but with relative upward motion of said turret (22) with respect to said vessel (12), said lower elastomeric pad (54) stays fixed relative to said load applying ring (36) thereby preventing tension in said lower elastomeric pad (52).

9. The arrangement of claim 8 wherein, said mounting plate (16) includes an annular ring (56) extending upwardly from an upper side thereof, and said lower elastomeric pad (52) is arranged and designed to slide within said annular ring (56) whereby with relative downward motion of said turret (22) with respect to said vessel (12), said lower elastomeric pad (52) is squeezed between said load applying ring (36) and said retaining ring (16), but with relative upward motion of said turret (22) with said respect to said vessel (12), said lower elastomeric pad (52) is free to slide upwardly with respect to said annular ring (56).

10. The arrangement of claim 7 further comprising, a retaining plate (66) coupled to said support ring (16) at a position above said load applying ring (36);

an upper elastomeric pad (54) is sandwiched between said retaining plate (66) and said load applying ring (36), said retaining plate (66) is coupled to said support ring (16) by a tie rod (70) which extends through aligned holes in said retaining plate (66), said upper elastomeric pad (54), said load applying ring (36), said lower elastomeric pad (52), and said supporting (16) and by nuts (72), (74) secured over said stud (70) above said retaining plate (66) and below said support ring (16).

11. The arrangement of claim 10 wherein, said upper elastomeric pad (54) is coupled, arranged and dimensioned in cooperation with said retaining plate (66) and said load applying ring (36) to be put in compression with relative upward motion of said turret (22) with respect to said vessel (12) but not be put in tension with relative downward motion of said turret (22) with respect to said vessel (12).

12. The arrangement of claim 10 wherein, said upper elastomeric pad (54) is fixed to said retainer plate (66) and to said load applying ring (36), and said retaining plate (66) is secured to said tie rod (70), whereby with relative upward motion of said turret (22) with respect to said vessel (12), said upper elastomeric pad (54) is squeezed between said retaining plate (66) and said load applying ring (36), but with relative downward motion of said turret (22) and said load applying ring (36) with respect to said vessel (12) and said mounting plate (16), said upper elastomeric pad (54) is prevented from being placed in tension because said tie rod (70) is free to slide with respect to said mounting plate (16).

* * * * *